United States Patent [19]

Tai et al.

[11] 4,452,717

[45] Jun. 5, 1984

[54] BUILT LIQUID DETERGENT COMPOSITIONS AND METHOD OF PREPARATION

[75] Inventors: Ho T. Tai, Santes, France; David A. Reed, Port Sunlight, England; Nicolaas J. F. D. Verhoef, Maasland, Netherlands; Fritz Deutscher, Dornbirn, Austria

[73] Assignee: Lever Brothers Company, New York, N.Y.

[21] Appl. No.: 248,094

[22] Filed: Mar. 27, 1981

[30] Foreign Application Priority Data

Apr. 9, 1980 [GB] United Kingdom ..... 8011744

[51] Int. Cl.[3] ..... C11D 9/10; C11D 15/04; C11D 17/00

[52] U.S. Cl. ..... 252/109; 252/110; 252/121; 252/132; 252/135; 252/173; 252/174.21

[58] Field of Search ..... 252/109, 110, 121, 132.5, 252/173, 174.21, DIG. 14

[56] References Cited

U.S. PATENT DOCUMENTS

| | | | |
|---|---|---|---|
| 3,232,878 | 2/1966 | Jones et al. | 252/110 |
| 3,501,408 | 3/1970 | Gabler et al. | 252/110 X |
| 3,684,723 | 8/1972 | Best et al. | 252/97 X |
| 4,057,506 | 11/1977 | Sung | 252/135 |
| 4,082,684 | 4/1978 | Kreischer | 252/121 X |
| 4,126,572 | 11/1978 | Tai | 252/109 X |
| 4,244,840 | 1/1981 | Straw | 252/540 |

FOREIGN PATENT DOCUMENTS

| | | |
|---|---|---|
| 1104028 | 6/1981 | Canada . |
| 2743910 | 4/1978 | Fed. Rep. of Germany . |
| 2819975 | 11/1978 | Fed. Rep. of Germany . |
| 2247534 | 5/1975 | France . |
| 2309629 | 11/1976 | France . |
| 2343806 | 10/1977 | France . |
| 2390497 | 12/1978 | France . |
| 1468181 | 3/1977 | United Kingdom . |
| 1530799 | 11/1978 | United Kingdom . |
| 1577140 | 10/1980 | United Kingdom . |

OTHER PUBLICATIONS

ZA 5615/77 (Abstract)-GE 2,743,910=CA 1,104,028.

*Primary Examiner*—Michael R. Lusignan

*Attorney, Agent, or Firm*—Amirali Y. Haidri; James J. Farrell

[57] ABSTRACT

A stable homogeneous aqueous liquid detergent composition contains 22 to 35% by weight of sodium tripolyphosphate and 6 to 15% by weight of an active detergent mixture comprising (a) a water-soluble anionic sulphonate or sulphate detergent; (b) an alkali metal soap of fatty acids having 12 to 18 carbon atoms, and (c) a nonionic detergent, in a weight ratio of (5.5–8.5):(0-.5–3):(1.5–3). The composition is a pourable liquid having a viscosity of 0.35–1.0 Pa s measured at 20° C. and at 21 seconds$^{-1}$ shear rate and remaining stable after at least two 24-hour cycles of from −4° C. to ambient temperature. Preferably the composition is prepared by mixing the ingredients in the proper sequence.

2 Claims, No Drawings

BUILT LIQUID DETERGENT COMPOSITIONS AND METHOD OF PREPARATION

This invention relates to built liquid detergent compositions and to processes for preparing such compositions. More particularly the invention relates to aqueous liquid detergent compositions comprising high levels of sodium tripolyphosphate, especially adapted for washing fabrics, manually and in the washing machine.

Liquid detergent compositions comprising sodium tripolyphosphate are known in the art, e.g. from French Patent Applications publication Nos. 2247534; 2309629; 2390497 and 2343806; German patent application No. 2819975; and U.S. Pat. Nos. 3,232,878 and 4,057,506. However the formulation of adequately built liquid compositions having a satisfactory laundering performance is limited not only by stability problems but also by certain viscosity boundaries as required for convenient dosing and handling both manually and in the machine. An acceptable and most convenient viscosity range for pourable liquid detergent compositions is from 0.35 to 1.0 Pascal seconds (≡350–1000 cP), preferably from about 0.5 to 0.8 Pascal seconds (≡500–800 cP).

Whereas for a satisfactory laundering performance comparable to that of conventional detergent powder compositions liquid detergent compositions should contain an adequate level of detergent active materials and builders equivalent to at least 22% by weight of sodium tripolyphosphate, it has not been possible hitherto to formulate a really stable liquid detergent composition having a viscosity of below 1.0 Pascal seconds with more than 20% by weight of sodium tripolyphosphate. As 15% is about the maximum level to which sodium tripolyphosphate can be dissolved in an aqueous liquid medium, any quantity of added sodium tripolyphosphate beyond said level must be kept in suspension. The greater the amount, the more difficult it is to control the viscosity and to keep the sodium tripolyphosphate in stable suspension in the liquid medium.

It has now been found that really stable and pourable homogeneous liquid detergent compositions can be prepared containing from 22 to about 35% by weight of sodium tripolyphosphate with a viscosity of between 0.35 and 1.0 Pascal seconds (Pa s) measured at 20° C. and at a shear rate of 21 seconds$^{-1}$.

The liquid detergent compositions of the invention, because of the well-balanced active detergent mixture, are capable of keeping sodium tripolyphosphate and any particulate matter in a stable homogeneous suspension whilst maintaining their liquid properties within the desired viscosity range. Under ambient conditions the liquid detergent compositions of the invention remain stable for months without any sign of separation.

A suitable means for measuring liquid stability is the so-called freeze-thaw stability test. The composition of the invention remains stable after at least two 24-hour cycles of from −4° C. to ambient temperature.

Accordingly the present invention provides a novel homogeneous aqueous liquid detergent composition containing 22 to 35% by weight of sodium tripolyphosphate and 6 to 15% by weight of an active detergent mixture comprising:

(a) a water-soluble anionic sulphonate or sulphate detergent;

(b) an alkali metal soap of fatty acids having 12 to 18 carbon atoms; and (c) a nonionic detergent;

which is characterised in that the weight ratio of (a):(b):(c) is within the range of (5.5–8.5)–(0.5–3):(1.5–3) and that the composition is a pourable liquid having a viscosity of 0.35 to 1.0 Pa s measured at 20° C. and at 21 seconds$^{-1}$ shear rate, and remaining stable after at least two 24-hour cycles of from −4° C. to ambient temperature.

The water-soluble anionic sulphonate detergents usable in the composition of the invention are for example the alkali metal salts of $C_{10}$–$C_{16}$ alkylbenzene sulphonates, $C_{10}$–$C_{20}$ alkane sulphonates, and $C_{10}$–$C_{20}$ olefin sulphonates, the alkali metal salts of alkylbenzene sulphonates being preferred, especially those derived from alkylbenzenes having a $C_{10}$–$C_{14}$ alkyl chain and average molecular weight of approximately 225–245.

The water-soluble anionic sulphate detergents usable in the composition of the invention are primary and secondary alkyl sulphates and alkylether sulphates having an alkyl chain length of about 8 to 20 carbon atoms, preferably 12 to 18 carbon atoms e.g. lauryl sulphate.

Typical examples of fatty acids having 12 to 18 carbon atoms are oleic acid, ricinoleic acid, and fatty acids derived from castor oil, rapeseed oil, groundnut oil, coconut oil, palmkernel oil or mixtures thereof. The sodium or potassium soaps of these acids can be used, the potassium soaps being preferred.

Suitable nonionic detergents for use in the present invention may be found in the following classes: fatty acid alkylolamides; alkylene oxide condensates of alkyl phenols or aliphatic alcohols, alkylamines, fatty acid alkylolamides and alkyl mercaptans; and amine oxides. Ethylene oxide condensates and mixtures of ethylene oxide condensates with fatty acid alkylolamides are preferred.

Particularly suitable ethylene oxide condensates have hydrophylic-lipophylic balance (HLB) values of between 11 and 15, such as $C_{13}$–$C_{15}$ alcohols condensed with 6–8 ethylene oxides.

Preferably the composition of the invention has a viscosity of from 0.5 to 0.8 Pa s measured at 20° C. and at a shear rate of 21 seconds$^{-1}$; a sodium triphosphate content of 25 to 32% by weight and an active detergent mixture content of 8 to 14% by weight.

While it is necessary to have the above detergent active mixture in the specified ratios in the aqueous compositions in order to achieve a stable product within the desired viscosity range, it has been found that it is also important to mix the ingredients properly agitated in the proper sequence in order to produce a product of uniform quality from batch to batch. If the mixing sequence and proper agitation disclosed below are not followed, varying rheological properties and reduced suspending capability can occur. If the mixing order and proper agitation as described below are followed, then successive batches especially when mixed in the same vessel will produce products of uniform viscosity and stability.

The ingredients are preferably mixed in the following manner.

The quantity of water is charged into a suitable mixing vessel provided with a stirrer. Anionic detergents, including soap, are then mixed into the water with moderate stirring. Desirably slight heating to about 70° C. is applied to dissolve the anionic detergents completely in the water.

The sodium tripolyphosphate is then mixed into the aqueous anionic detergent solution with continued stirring whilst maintaining the temperature at the appropriate level of about 70°–75° C. until a homogeneous mass is obtained.

The nonionic detergent is then mixed into the mass and stirring is continued.

Finally the mixture is cooled under constant agitation and water is added, if necessary, to compensate evaporation loss during the first stages of operation. Thereafter perfume may be added when the product is at substantially ambient temperature.

The liquid detergent composition of the invention may further contain any of the adjuncts normally used in fabric washing detergent compositions e.g. sequestering agents such as ethylenediaminetetraacetate; alkali silicates for adjusting the pH; soil suspending and anti-redeposition agents such as sodium carboxymethylcellulose, polyvinylpyrrolidone etc; fluorescent agents; perfumes, germicides and colourants.

Further the addition of lather depressors such as silicones; and enzymes, particularly proteolytic and amylolytic enzymes; and peroxygen or chlorine bleaches, such as sodium perborate and potassium dichlorocyanurate, including bleach activators, such as N,N,N',N'-tetraacetylethylenediamine, may be necessary to formulate a complete heavy duty detergent composition suitable for use in washing machine operations. These ingredients can be employed in the liquid detergent composition of the invention without danger of undue decomposition during storage if a proper protective coating is applied.

The presence of such additional solid particles will not affect substantially the viscosity and stability of the liquid detergent composition of the invention.

EXAMPLE 1

A 4 kg batch of an aqueous liquid detergent composition was prepared: 705 grams of water were charged into a 5 liter vessel provided with a stirrer. The appropriate amounts of sodium silicate, sodium carboxymethylcellulose, sodium alkylbenzene sulphonate, potassium oleate and fluorescent agent, all in aqueous solutions, were successively introduced and mixed into the water with moderate stirring under slight heating until the temperature reached about 60°–70° C. Heating was stopped and 1080 grams of sodium tripolyphosphate was mixed into the aqueous solution with continued stirring until a homogeneous mass was obtained. Thereafter the appropriate amounts of alcoholethoxylate and ethanolamide nonionics were mixed into the mass. The mixture was then allowed to cool under constant agitation and thereafter additional water and perfume were added.

A stable, white opaque, homogeneous and pourable liquid detergent of the following composition was obtained:

| Composition | 1 (% by weight) |
|---|---|
| sodium $C_{12}$—alkylbenzene sulphonate | 6.5 |
| potassium oleate | 1.6 |
| $C_{13}$–$C_{15}$ alcohol/7 ethylene oxide | 1.3 |
| coconut monoethanolamide | 1.4 |
| sodium carboxymethylcellulose | 0.05 |
| sodium tripolyphosphate | 27.0 |
| sodium silicate | 2.0 |
| fluorescent agent | 0.1 |
| water + perfume | up to 100.0 |
| viscosity (20° C.; 21 seconds$^{-1}$ shear rate) | 0.5 Pa s |

-continued

| Composition | 1 (% by weight) |
|---|---|
| pH (5 g/liter solution) | 8.5 |

This composition was stored in transparent plastic bottles under ambient conditions and remained stable after two months. When subjected to a freeze-thaw stability test the composition remained stable after four 24-hour cycles of from −4° C. to ambient temperature with no sign of separation being observed.

EXAMPLES 2–4

The following stable, white opaque, homogeneous and pourable liquid detergent compositions were prepared:

| Composition (% by weight) | 2 | 3 | 4 |
|---|---|---|---|
| sodium $C_{12}$—alkylbenzene sulphonate | 5 | 6.5 | 8.4 |
| potassium oleate | 1.25 | 1.6 | 2.1 |
| $C_{13-15}$ alcohol/7 ethylene oxide | 1 | 1.3 | 1.75 |
| coconut fatty acid mono-ethanolamide | 1 | 1.4 | 1.75 |
| sodium carboxymethylcellulose | 0.1 | 0.05 | 0.05 |
| sodium tripolyphosphate | 27.0 | 30.0 | 27.0 |
| sodium silicate | — | 2.0 | 2.0 |
| fluorescent agent | 0.1 | 0.1 | 0.1 |
| perfume | 0.4 | 0.4 | 0.4 |
| water up to | 100 | 100 | 100 |
| viscosity at 21 sec$^{-1}$ shear rate | 0.5 Pa s | 0.66 Pa s | 0.68 Pa s |
| pH (5 g/liter solution) | 7.5 | 8.5 | 8.5 |

The compositions were subjected to freeze-thaw stability tests and remained stable after four 24-hour cycles of from −4° C. to ambient temperature with no sign of separation being observed. The compositions remained stable after at least 2 months storage under ambient conditions. No change in physical appearance or viscosity was observed.

EXAMPLE 5

The following stable, white opaque, homogeneous and pourable heavy duty liquid detergent composition was prepared:

| Composition | (% by weight) |
|---|---|
| sodium $C_{12}$—alkylbenzene sulphonate | 6.4 |
| potassium groundnut fatty acid soap | 1.5 |
| $C_{13-15}$ alcohol/7 ethylene oxide | 2.0 |
| sodium carboxymethylcellulose | 0.2 |
| sodium tripolyphosphate | 25.0 |
| magnesium ethylenediaminetetraacetate | 0.5 |
| fluorescent agent | 0.1 |
| encapsulated chlorine bleach | 5.0 |
| encapsulated protaolytic enzyme + silicone | 1.0 |
| sodium metasilicate | 2.0 |
| water + perfume | 56.3 |
| viscosity (at 21 sec.$^{-1}$ shear rate and 10°C.) | 0.55 Pa s |
| pH (5 g/liter solution) | 8.5 |

The composition remained stable after two 24-hour cycles of from −4° C. to ambient temperature with no sign of separation.

The composition performed excellently in a fabric washing machine test at medium temperatures in terms of lather, bleaching and cleaning.

We claim:

1. A method for preparing a homogeneous aqueous liquid detergent composition containing 22 to 35% by weight of sodium tripolyphosphate and 6 to 15% by weight of an active detergent mixture comprising:

(a) a water-soluble anionic sulphonate or sulphate detergent;

(b) an alkali metal soap of fatty acids having 12 to 18 carbon atoms; and (c) a nonionic detergent, characterized in that the weight ratio of (a):(b):(c) is within the range of (5.5–8.5):(0.5–3):(1.5–3) and that the composition is a pourable liquid having a viscosity of 0.35 to 1.0 Pa s at 20° C. and 21 seconds$^{-1}$ shear rate, and remaining stable after at least two 24-hour cycles of from −4° C. to ambient temperature; comprising:

mixing said anionic sulphonate or sulphate detergent and said soap with water to form an aqueous mixture;

mixing said sodium tripolyphosphate with said mixture to form a homogeneous mass, with continued stirring;

mixing said nonionic detergent with said homogeneous mass with continued stirring to form a final mixture; and allowing said final mixture to cool with continued stirring to form a final product.

2. A product prepared by the process of claim 1.

* * * * *